US007124958B2

(12) United States Patent
Schultz et al.

(10) Patent No.: US 7,124,958 B2
(45) Date of Patent: Oct. 24, 2006

(54) CONTROLLED SNOW-MAKING PROCESS AND APPARATUS

(75) Inventors: Paul Schultz, Piedmont, SC (US); Timothy Dougherty, Fountain Inn, SC (US)

(73) Assignee: Michelin Recherche et Technique S.A., Granges-Paccot (CH)

( * ) Notice: Subject to any disclaimer, the term of this patent is extended or adjusted under 35 U.S.C. 154(b) by 0 days.

(21) Appl. No.: 10/886,916

(22) Filed: Jul. 8, 2004

(65) Prior Publication Data

US 2005/0001049 A1 Jan. 6, 2005

Related U.S. Application Data

(63) Continuation of application No. PCT/US02/00440, filed on Jan. 9, 2002.

(51) Int. Cl.
*F25C 3/04* (2006.01)

(52) U.S. Cl. ..... 239/2.2; 239/14.2; 73/146; 404/71

(58) Field of Classification Search ..... 239/2.2, 239/14.2; 62/74; 73/8, 9, 146; 404/71
See application file for complete search history.

(56) References Cited

U.S. PATENT DOCUMENTS 3,964,682 A * 6/1976 Tropeano et al. ..... 239/2.2
4,214,700 A 7/1980 Vanderkelen et al.
4,593,854 A 6/1986 Albertsson
4,742,958 A * 5/1988 Bucceri ..... 239/2.2
5,230,218 A * 7/1993 Clulow ..... 62/74
5,272,883 A 12/1993 Matsui et al.
5,289,973 A 3/1994 French
5,836,513 A 11/1998 Smith et al.
6,408,689 B1 * 6/2002 Usami et al. ..... 73/146
6,626,607 B1 * 9/2003 Hiramatsu et al. ..... 404/71

FOREIGN PATENT DOCUMENTS

JP 2000-336604 A 5/2000

OTHER PUBLICATIONS

Patent Cooperation Treaty PCT—International Search Report, PCT/US02/00440, established May 9, 2002.

* cited by examiner

*Primary Examiner*—Steven J. Ganey
(74) *Attorney, Agent, or Firm*—E. Martin Remick; Adam Arnold; Frank Campigotto

(57) ABSTRACT

A method and apparatus suitable for producing an artificial snow surface for tire evaluation is provided. The process provides for manufacturing a series of snow layers, each layer followed by a packing and a grooming step to provide a multi-layered snow surface. Desirable shear strength properties of the snow surface are enhanced by a surface grooming technique that applies a layer of water to the upper snow surface followed by grooming of the surface. The manufactured snow surface allows the testing and evaluation of tires that compares favorably to tire evaluation data obtained from outdoor testing facilities.

13 Claims, 4 Drawing Sheets

CONTROLLED SNOW-MAKING PROCESS AND APPARATUS

CROSS-REFERENCE TO RELATED APPLICATIONS

This application is a continuation of International Application No. PCT/US02/00440, filed 09 Jan. 2002.

FIELD OF THE INVENTION

This invention is directed towards a method and associated apparatus to provide an indoor snow test track that may be used to evaluate a tire's performance under snow conditions.

BACKGROUND OF THE INVENTION

Outdoor testing grounds are conventionally used to evaluate a tire's performance under various snow and ice conditions. Standardized methodology for evaluating tire traction and other performance data is widely practiced within the industry. One such ASTM standard followed by the industry includes ASTM designation: F 1805-98 entitled, "Standard Test Method for Single-Wheeled Driving Traction in a Straight Line on Snow—and Ice—Covered Surfaces" and which is incorporated herein by reference. The ASTM methodology sets forth a procedure used by the tire industry to evaluate a tire's performance on snow and ice.

There currently exists outdoor tire evaluation test tracks. These test tracks are utilized for tire evaluation techniques on snow and ice using the ASTM procedures described above. The performance characteristics of a given tire are made in comparison to the performance of a reference tire. The standard specification for a radial reference test tire uses the ASTM standard E 1136-93 (Re-approved in 1998) and which is incorporated herein by reference.

In the development of a new tire, it is desirable to undergo snow performance evaluation of the tire. Further, a snow evaluation setting forth minimum performance standards is required before a tire may carry industry designations as a snow tire.

Outdoor test facilities make every effort to maintain a uniform and reproducible snow track surface. However, there are inherent limitations in an outdoor track's ability to maintain a uniform evaluation snow track. Fluctuations in temperature, natural snowfall, humidity, and the presence or absence of direct sunlight are all factors that can produce differences in the quality and characteristics of the snow test surface. Indeed, changes over a single day can bring about significant differences in the quality of the test track surface. Further, there are additional limitations to outdoor evaluation tracks since such tracks operate on a seasonal basis and are largely dependent upon natural snowfall.

There have been prior efforts within the art to carry out tire evaluations on indoor manufactured snow surfaces. These efforts have included blowing layers of snow followed by packing of the blown snow. In addition, applications of water to the snow surface have been used in an attempt to improve the snow quality. While such an artificial snow surface may permit relative traction or braking comparisons between tires, there remains room for improvement in the art.

SUMMARY OF THE INVENTION

It is one aspect of the present invention to provide a method of supplying an indoor snow facility which provides a snow surface that achieves Standard Reference Test Tire (SRTT) traction values as set forth within ASTM F 1805 guidelines. It is yet an additional aspect of the present invention to provide a method of producing an indoor snow tire evaluation surface which can be maintained at a consistent performance level over time.

It is yet another aspect of the present invention to provide a process of manufacturing an artificial snow surface under controlled climatic conditions. It is yet another aspect of the present invention to provide a process of establishing and maintaining an artificial snow surface for tire evaluation so as to achieve uniformity of test data and results irrespective of the test facility location.

It is yet another aspect of the present invention to provide an indoor test facility for evaluating a tire's snow performance and which may be readily correlated to the identical tire's performance values obtained at an outdoor test track facility.

It is yet another aspect of the present invention to provide a configuration for a snow blowing apparatus that is useful for establishing a snow test track surface within a controlled environment.

It is yet another aspect of the present invention to provide a process of conditioning an artificial snow test track so as to achieve a more uniform test track surface. It is yet another aspect of the present invention to provide a process for packing and grooming an outdoor snow evaluation surface of either natural and/or artificial snow, thereby increasing the frequency with which the facility may be used. It is yet another aspect of the present invention to provide a process of making a snow surface suitable for the evaluation of a tire comprising: (a) providing an environmental chamber; (b) establishing a temperature within the environmental chamber below a freezing point of water; (c) providing a foundation layer of ice on a floor of the environmental chamber; (d) providing at least one snow-making apparatus within the environmental chamber; (e) adjusting a temperature within the environmental chamber to between about −5° F. to about 20° F.; (f) producing a first snow layer onto the foundation layer of ice, said first snow layer having a thickness of between about 0.5 to about 1.5 inches; (g) lowering the temperature within the environmental chamber to a temperature between about −20° F. to about 10° F.; (h) producing an additional layer of snow on top of the first snow layer, the additional snow layer having a thickness of between about 1 to about 2 inches; (i) packing the additional layer of snow; (j) applying a coating of water to an upper surface of the additional layer of snow; (k) grooming the water coated additional layer of snow; (l) repeating steps (h) through (k) until an operative thickness of packed and groomed snow is produced; and, (m) raising a temperature of the environmental chamber to between about 10° F. to about 25° F., thereby providing a snow surface shear strength suitable for establishing traction values for a vehicle tire.

These and other features, aspects, and advantages of the present invention will become better understood with reference to the following description and appended claims.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DESCRIPTION OF THE PREFERRED EMBODIMENT

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus or process pathway. To avoid redundancy, detailed descriptions of much of the apparatus once described in relation to a figure is not repeated in the descriptions of subsequent figures, although such apparatus or process is labeled with the same reference numbers.

Methods and machines for making artificial snow are well known within the art. For example U.S. Pat. Nos. 5,167,367 and 4,214,700, both assigned to Snow Machines, Inc., of Midland, Mich., and U.S. Pat. No. 4,105,161 assigned to Boyne Mountain Lodge, Inc., in Boyne Falls, Mich., each provide an apparatus and process suitable for making artificial snow used for ski resorts. The disclosures of the three patents set forth above are incorporated herein by reference in their entirety.

The present invention is not limited to any one particular type of snow-making apparatus. Rather, it is believed that any conventional snow-making equipment may be used in accordance with the illustrations and teachings which follow.

Figure 1:
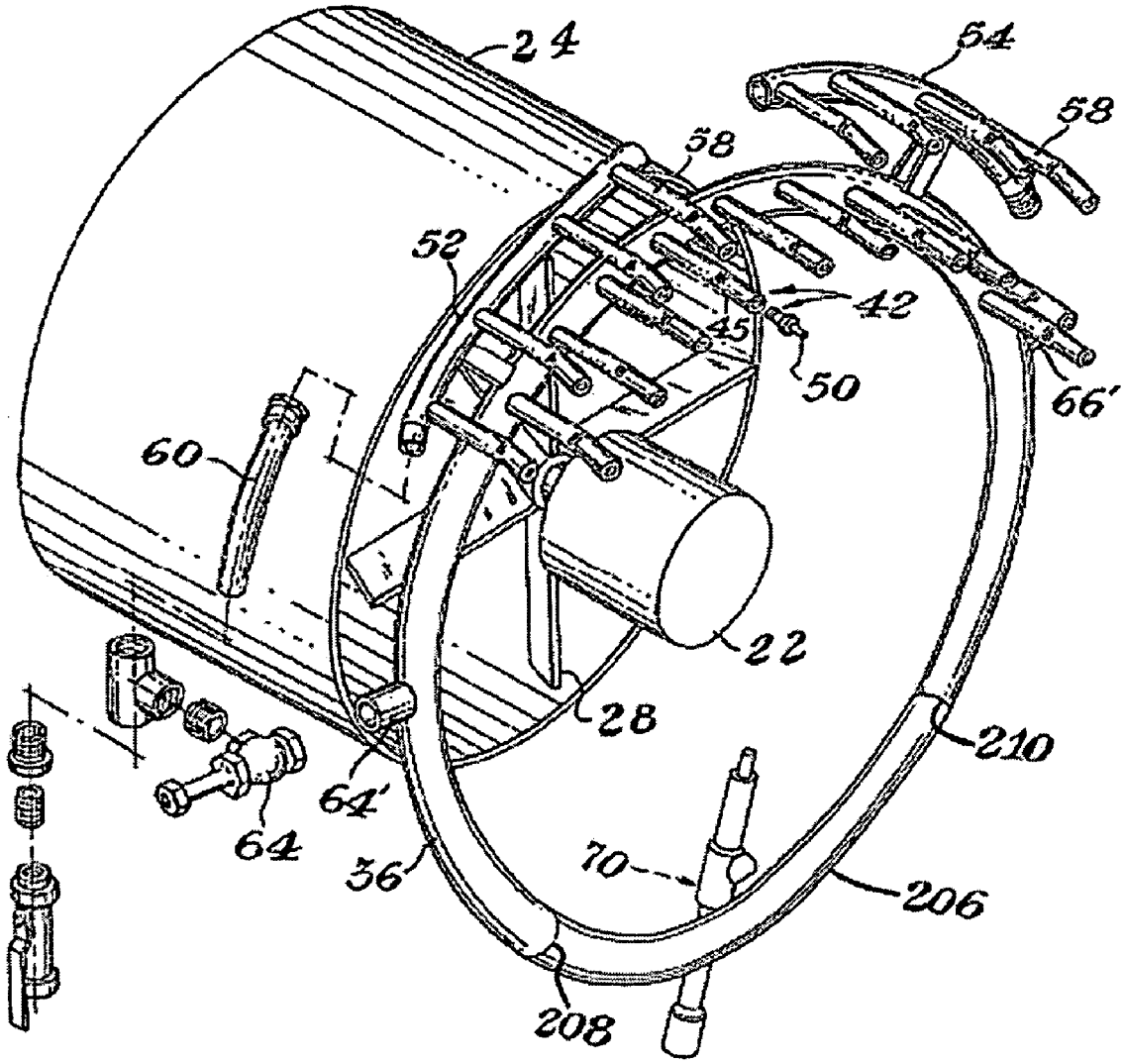
FIG. 1 is perspective view of a snow-blowing apparatus useful in the practice of the present invention.
Figure 2:
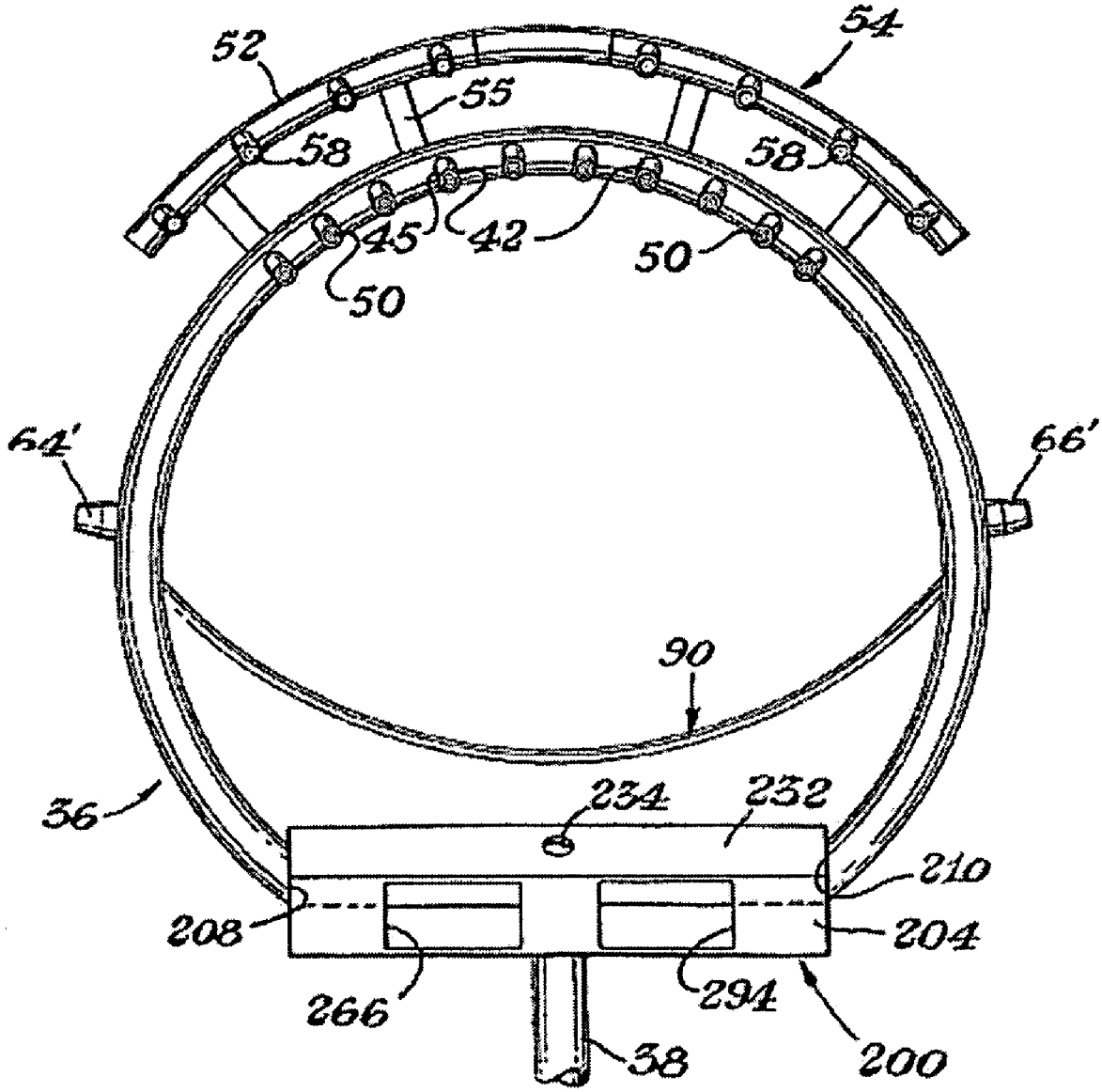
FIG. 2 is an exploded perspective view of the snow-blowing apparatus of FIG. 1 setting forth additional details of the snow-blowing apparatus.

As set forth in FIGS. 1 and 2, there is illustrated a representative snow-making apparatus. The snow machine apparatus has a main manifold 36 which conducts bulk water to an arcuate array of water nozzles 42. Each nozzle 42 comprises a first member 45 operatively engaging the main manifold 36. A replaceable nozzle 50 is threadably received into a free end of connector 45. The nozzles 50 may be readily replaced and interchanged. For instance, various nozzles 50 define different diameter orifices to regulate the output per nozzle. For instance, at a supply pressure of 150 psi, a number 5 nozzle having an orifice diameter of 0.0625 will produce a flow rate of 2.1 gpm. A number 16 nozzle having an orifice diameter of 0.2500 will have a flow rate of 20 gpm at a 150 psi supply pressure. Upon increasing the pressure to 500 psi, the respective flow rates will increase to 3.7 and 38 gpm respectively. As such, by controlling the pressure and the selected nozzles, it is possible to regulate the volume of water supplied through the snow-making apparatus.

A pair of arcuate manifolds 52 and 54 are carried by supports 55 radially outwardly of manifold 36 and have a plurality of water spray nozzles 58, similar to nozzles 42, extending axially thereon. Water is supplied to these upper manifolds 52 and 54 from the primary manifold 36 by a pair of couplings 64' and 66' connected by hoses 60 and 62 (not shown) and manifold 52 and 54. Water flow to the upper manifolds 52 and 54 is controlled by a water shut off valve (not shown) relative to manifold 52 and a similar corresponding valve (not shown) associated with line 62 (not shown) leading to upper manifold 54.

An electric motor 22 is supported within a cylindrical housing 24. Motor 22 is used to engage radial blades 28 so as to generate a uni-directional high-volume air stream. Attached to manifold 36 is a seed nozzle 70 affixed such that nozzle 70 is directed toward the air stream at an outward angle of about 60° to a centerline of the housing 24. Nozzle 70 is used to direct a mixture of compressed air and water such that an expansion of the mixture from the nozzle 70 causes the formation of seed crystals in the air stream.

As seen in reference to FIG. 1, there are two annular rows of respective nozzles 58 and 42 positioned along the upper portion of the manifold 36. As discussed in the patents referenced above, it is believed that this arrangement of nozzles results in an increased quality and quantity of formed snow under a variety of different temperature conditions. In accordance with this invention, a nozzle arrangement has been developed which is useful in establishing an artificial snow surface. As best seen in reference to FIG. 1, the uppermost rows of nozzles, going from left to right, have the manufacturer's nozzle designation of 8, 10, 6, 10, 10, 6, 10, and 8. The bottom row of nozzles, going from left to right, have designations of 8, 6, 10, 6, 10, 10, 6, 10, 6, and 8.

The number 6 nozzle designation has a diameter orifice of 0.0938 inches. The number 8 designation defines an orifice diameter of 0.1250 inches and the number 10 nozzle designation has an orifice diameter of 0.1563 inches. At a water supply pressure of 65 psi, the number 6 nozzle produces a flow rate of about 1.7 gpm. The number 8 designation provides a flow rate of about 3.5 gpm, while the number 10 nozzle provides a flow rate of about 5.2 gpm.

The water supplied to each snow-making machine is at a flow rate of about 64 gpm and at a supply pressure of about 65 to about 70 psi. As is conventional within the art, the snow-making apparatus is mounted on a sled or wheeled-type frame to facilitate the movement and positioning of the snow-making apparatus. Additional details of the construction and operation of a suitable snow machine may be found in specific reference to the drawings and specification set forth in U.S. Pat. No. 4,214,700, and in further reference to the "Operating and Parts Manual Highland® Snowmaker", November 1991, published by Snowmakers, Inc., and incorporated herein by reference in its entirety.

The tire evaluation snow track was produced inside a 225'×225' cold chamber equipped with commercial refrigeration/freezer units capable of bringing and maintaining the facility to a temperature of at least −20° F. Prior to the generation of the artificial snow surface, a foundation layer of ice was formed on the floor of the cold chamber using water applied by fire hoses. The foundation layer of ice provides a layer of insulation and additionally improves the adhesion of a first snow layer base as is described below.

First Snow Layer

An initial layer of snow is applied to the foundation layer of ice using a pair of snow-blowing machines. (Boyne Model, Snow Machines, Inc., Midland, Mich.) It has been found preferable to raise the temperature inside the environmental chamber to a temperature of about 0° F. to about 10° F. or greater so as to provide for a first layer of a wet or slushy snow. The moisture of the manufactured snow sticks to the foundation ice layer. The snow machine producing the base layer of moist snow is set at an angle of about 25° above a horizontal reference plane. The snow-making equipment is operated for a 3 minute interval which applies a base layer of wet snow that is concentrated over a distance of between 12 to 25 feet. At the end of each 3 minute interval, the snow machine equipment is moved backwards about 12 feet and allowed to operate for another 3 minute interval. This process is repeated until the desired length and width of the evaluation area has the base layer of snow. The thickness of the base snow layer is about 0.5 to 1.5 inches.

Following application of the base layer, the temperature of the environmental chamber is lowered to between −20° F. to about 10° F. and more preferably to between about 0° F. to about 5° F. As the temperature is lowered, the wet base layer of snow is allowed to harden by the decrease in surrounding air temperature.

Second Snow Layer

A second snow layer is produced at about 0° F. Using the above described equipment, the snow produced at this temperature constitutes a dry, powdery snow. It has been found that the dry snow layer can be conditioned to provide a medium, hard-packed snow surface. The snow machine is set at an angle of approximately 45° above horizontal. The 45° angle has been found to work well for the production of the drier snow layer. A snow-making interval of about 4 minutes per 12 foot section is used to apply the second snow layer. The second snow layer has a thickness, following the packing and grooming steps described below, of about 1.0 to about 2.0 inches. The movement of the snow-making equipment over fairly short time intervals avoids uneven accumulations of snow and facilitates subsequent packing and grooming steps.

Following the production of the second snow layer, the snow surface is groomed and packed as described in the relevant sections set forth below. Following grooming, a third and fourth snow layer using temperatures of between about 0° F. to about 10° F. is applied.

Third Snow Layer

Following the application of the second snow layer, a third layer of snow is produced using a time interval of about 4 minutes per 12 foot section. The thickness of the third snow layer is, following the packing and grooming steps, about 1.0 to about 2.0 inches. The third snow layer is groomed and conditioned as was done for the second snow layer.

Fourth Snow Layer

Following the application of the third snow layer, a fourth layer of snow is produced using a time interval of about 3 to about 4 minutes per 12 foot section. Thereafter, the snow surface is groomed and conditioned in a manner similar to layers 2 and 3 to achieve a thickness of the fourth layer of about 1.0 to about 2.0 inches.

In accordance with this invention, it has been found that setting multiple passes of the snow machine at intervals of about 3 to about 6 minutes offers a snow surface having improved qualities than generating a single snow layer using a longer time interval. The shorter, 3 minute interval is used when a portion of the produced snow impinges upon an interior wall of the environmental chamber. As such, the snow accumulation is greater in such areas and a shorter time interval is needed to achieve the desired snow layer thickness. Applying thicker snow layers using a longer time interval was found to make packing and grooming of the snow into a desirable tire evaluation surface more difficult and resulted in a poorer quality end product than the multiple layer approach of the present invention.

Typically, by the time the fourth snow layer has been manufactured, there is a sufficient amount of packed snow to carry out standardized tire evaluation tests. Preferably, the packed snow surface has a depth of at least 5 inches and more preferably about 6 inches. The snow surface should have a sufficient depth to allow for penetration of the tire yet maintain the tread surface of the spinning tire from engaging the foundation ice layer.

Snow Packing

Following the application of each of the second through fourth snow layers, a packing sled is passed over the surface of the manufactured snow. The packing sled is a small-wheeled vehicle having two rows of pneumatic tires positioned in an overlapping fashion. Each tire is inflated to about 30 psi. The overlapping profile of the pneumatic tires insures the entire snow surface is compressed and compacted by the packing sled. Similar packing sleds are used with outdoor tire evaluation sites and are well known within the relevant art.

Snow Surface Grooming

Following the packing step of each of the second through fourth snow layers, a mechanical groomer is used to texture the upper surface of the packed snow. The mechanical groomer is similar to other groomers used by outdoor tire testing facilities and is comprised of a sled defining a row of multiple teeth extending along a rear edge of the sled. The teeth of the sled are designed to extend approximately 1 inch into the snow surface. The groomer is towed by a vehicle and is designed to work the upper surface of the packed snow.

During the snow manufacturing process, the second and subsequent layers of snow are in the form of a dry snow. Accordingly, following the formation and packing of the second snow layer, a layer of water is applied in conjunction with a first pass of the grooming sled. The water is applied from a gravity feed distributor such as a drip bar which may be in the form of a pipe defining a plurality of ½ inch diameter holes along 6 inch centers. The water is applied at a rate of about 1 gallon per 100 square feet of treated snow surface. The water is not separately heated but is dispensed from a tank filled with tap water at ambient tap supply temperatures. During the passage of the grooming apparatus, the water layer is applied as a drip line onto the snow's surface immediately prior to engagement with the sled teeth. A second "dry" pass of the groomer is made without additional water being applied, followed by a transverse or cross direction "dry" pass of the grooming sled.

Following the packing of the third snow layer, an additional layer of water is applied during the first grooming pass. The additional water is applied at a rate of about 1.6 gallons per 100 square feet of snow surface. As described above in reference to the grooming of the second snow layer, a subsequent second dry groomer pass and a cross direction dry pass of the groomer are made.

Typically, following the manufacture and application of the fourth snow layer, there is adequate snow pack such that a tire evaluation can be conducted. Additional packing and grooming of the snow pack surface fourth layer is conducted including application of an additional layer of water during the first pass of the grooming sled. The water is applied at a rate of between about 1 to about 1.6 gallons per 100 square feet of snow surface. The application of the water in the manner indicated herein has been found to provide adequate shear strength to the snow surface. The shear strength is determined by standard hardness measurements and observations of vehicle penetration. The packed snow shear strength is also affected by the indoor temperature and humidity profiles.

As described herein, a useful volume of applied water ranges from about 1 to about 1.6 gallons per 100 square feet of a packed snow surface. The addition of water to the respective snow layer(s) has been found useful in establishing a suitable snow surface for tire evaluation purposes. The manufactured snow is typically a dry powder which, following the addition of water, can be groomed more easily into a suitable tire evaluation surface. The amount of water applied to the snow surface may be varied depending upon the moisture content of the available snow, the ambient humidity, current air temperature surrounding the snow, as well as prior temperature adjustments. As temperature and humidity vary, the volume of water applied as set forth in the preferred embodiments may need to be varied. Such variation can be done without undue experimentation so as to achieve a snow evaluation surface suitable for testing tires. As such, it is envisioned that the volume of water needed may be greater or less than the stated ranges described above.

Once the desired snow set up has been achieved, temperature in the environmental chamber is raised to a tire testing temperature of between about 10° F. to about 25° F. and more preferably to about 15° F. to about 20° F. This temperature range has been found to achieve a snow surface during tire evaluation that is comparable to the snow surfaces used at various outdoor test facilities.

The present invention also allows one to evaluate the identical tire at multiple temperatures by allowing the ambient air and snow surface temperature to equilibrate to a desired value. For instance, certain tire and/or tread designs may have varying performance at different temperatures. The ability to rapidly change testing temperatures allows for correlation of tire performance under different temperature conditions.

The actual evaluation of the control reference tire and the tire to be evaluated is conducted as set forth in the ASTM standards and uses the same type of equipment and procedures conventionally used in an outdoor testing facility. Following the testing, the snow surface is re-groomed using two normal dry passes of the groomer along with one cross grooming dry pass. Once tire testing has begun, it has been found that dry grooming of the test lanes is adequate to maintain a suitable snow track surface. However, should the surface of the snow become degraded, it is possible to lower the environmental chamber to a set up temperature such as about 0° F. to about 5° F. and undergo additional applications of water in the grooming process as referenced above in order to again achieve a suitable snow for carrying out tire traction evaluation studies. If desired, an additional snow layer having a thickness of about 0.5 to about 2.0 inches may be applied to the snow surface. The new snow layer may be packed and groomed using the techniques discussed above. In this manner, it is possible to renew the test track surface as needed to maintain the desired snow surface qualities.

In accordance with this invention, it has been found that the packing, watering, and grooming of the snow as outlined above allows an artificial snow surface to be provided which will yield SRTT traction values in accordance with ASTM F 1805 guidelines. In addition, the artificial snow surface has also been found to work well with other spin rating evaluation tests used within the industry. Data from the indoor test facility has been found to correlate well with an identical tire's performance at outdoor testing facilities. The ability to achieve an artificial snow track surface that conforms to standards used at outdoor facilities represents an important advancement within the industry. The present invention allows tire evaluation studies to be conducted year round since the seasonal requirements of natural snowfall are no longer a limiting factor. Additionally, tire testing can be carried out in other geographic locations of the country and allows evaluation facilities to be placed closer to tire research and development locations. Additionally, the tire evaluation process may be carried out in a more rapid fashion since delays attributable to variations in local weather can now be avoided. As such, key personnel are not delayed in carrying out the tire evaluation and the process enables a more organized and productive scheduling of tire testing.

The present invention also provides for a more uniform snow evaluation process than is presently available using outdoor evaluation sites. Outdoor facilities have inherent variations in test conditions from day-to-day and week-to-week based upon changes in ambient temperature, humidity, sun light, and the amount and quality of natural snow fall Further, the present invention facilitates the creation of similar conditions at other facilities or at other times within the same facility. This ability permits better comparison of tire traction tests conducted at different times and/or locations. Further, the identical tire can be evaluated easily at different temperatures. It is known that a tire's traction performance on snow may vary depending upon the operating temperatures. The present invention allows this comparative data to be obtained. Heretofore, the reliance upon ambient temperatures at outdoor facilities largely precluded the collection of comparative temperature test data.

The tire evaluation data obtained from the artificial snow surface compares favorably with the identical actual tire when separately evaluated at an outdoor test facility. As seen in reference to FIGS. 3 A and 3 B, the indoor test facility located in Florida generated tire data points for tire spin ratings which correlate closely with results when the identical tires were separately evaluated at an outdoor test facility in Montana (3A) and in Michigan (3B). As seen in reference to FIG. 4, spin ratings between the two outdoor facilities and the indoor facility exhibit no significant differences. To the extent slight variations exist in the data, it is noted that the variations are within the range of differences seen between comparisons of the two outdoor test facilities.

Figure 3A:
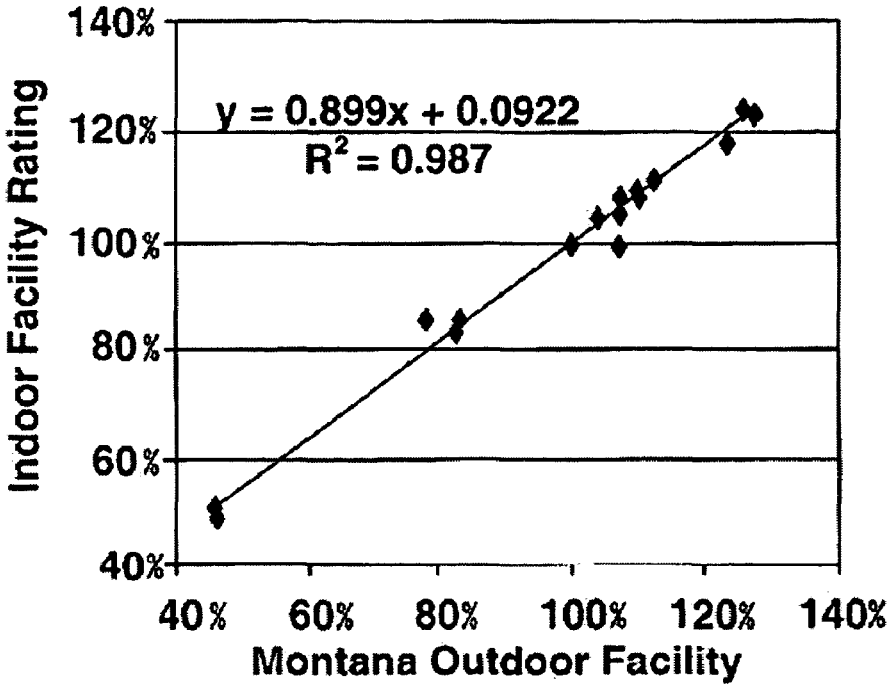
FIGS. 3A and 3B depict graphs showing the correlation between tire evaluations performed at an indoor test facility with the identical tires evaluated at two different outdoor test facilities in Montana and Michigan, respectively.
Figure 3B:
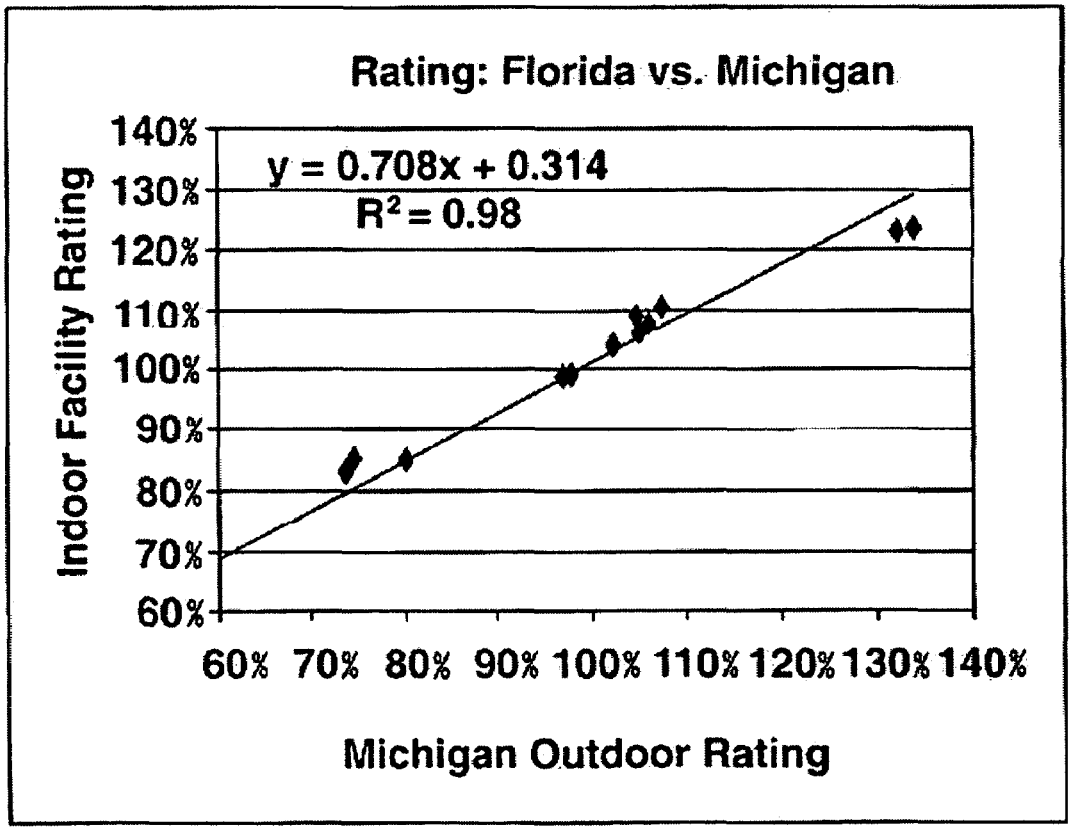

As seen in reference to the data in FIGS. 3A and 3B, a wide-range of tires were selected. Selected tires included those that were known to perform poorly in comparison to a standard reference tire along with tires having improved performance characteristics relative to the reference tire. As seen, the plotted values for the indoor Florida facility correlate well for all types of tires evaluated in comparison to the reference line reflecting the data obtained from the outdoor facilities located in Montana and Michigan.

Figure 4:
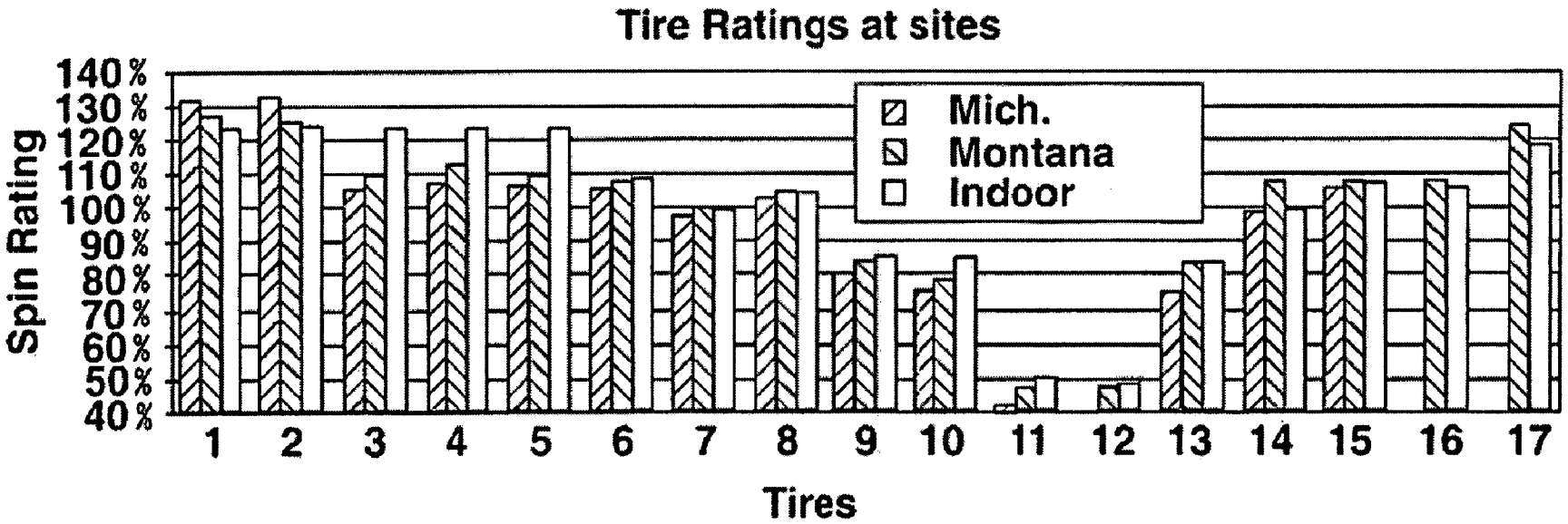
FIG. 4 is a graph indicating spin test data obtained from identical tires at an indoor test facility along with two different outdoor test facilities.

As indicated by the comparative data set forth in FIGS. 3A, 3B, and 4, the present invention provides a test surface which has excellent correlation with respect to outdoor tire testing facilities. The strong correlation between the indoor test facility and the outdoor test facility establishes the present invention's ability to provide an artificial manufactured snow surface which, for the purposes of tire evaluations, is indistinguishable from tire test facilities using a natural snow base. Further, the correlation between the indoor snow surface and the outdoor natural snow test facilities is consistent with respect to all types of tires evaluated. As indicated, tires which perform either substantially better or substantially worse than a reference tire, achieve values on the indoor test facility similar to values obtained at an outdoor test facility.

The strong correlation that can be achieved between the indoor test snow surface and the respective outdoor snow test surfaces is useful in establishing an indoor snow test surface. A tire, previously evaluated on a conventional outdoor track, should exhibit similar performance results on an indoor test track that is properly groomed and conditioned. Accordingly, comparison of a tire, having known performance characteristics on an outdoor snow surface, to the identical tire's performance on an indoor or manufactured snow surface, is a useful technique for verifying the quality and consistency of a manufactured snow surface. As such, by using known "control" tires, one can verify the suitability of an indoor test track surface in reference to actual tire performance obtained at outdoor test facilities.

The present invention is particularly well suited for producing and maintaining an indoor snow surface suitable for conducting industry standard tire evaluations on snow. However, it is believed that the present invention also affords improvements useful with respect to an outdoor test facility. To meet the applicable ASTM test and performance standards, outdoor snow surfaces used for tire evaluation also require packing and grooming steps. At times, outdoor facilities may receive fresh snow that has properties similar to the dry, sugary manufactured snow produced in accordance with the present invention. It is believed that the surface of a packed, dry natural snow may be improved for tire evaluation purposes by a grooming step in conjunction with the application of water to the snow surface. The ability to provide an improved surface to natural snow allows larger time intervals for testing.

Further, an outdoor test facility may also rely upon a manufactured snow layer along with the described packing and grooming steps of the present invention to enhance the natural snow surface. In this manner, a fresh manufactured snow surface may be supplied to an existing natural snow base at times when natural snowfall has not occurred. Using a manufactured supplemental snow layer along with the packing, watering, and grooming techniques described herein, a suitable surface may be re-established more quickly at an outdoor facility than may otherwise be possible when relying upon natural snowfall.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A process of making a snow surface suitable for the evaluation of a tire comprising:

(a) providing an environmental chamber;

(b) establishing a temperature within the environmental chamber below a freezing point of water;

(c) providing a foundation layer of ice on a floor of the environmental chamber;

(d) providing at least one snow-making apparatus within the environmental chamber;

(e) adjusting a temperature within the environmental chamber to between about −5° F. to about 20° F.;

(f) producing a first snow layer onto the foundation layer of ice, said first snow layer having a thickness of between about 0.5 to 1.5 inches;

(g) lowering the temperature within the environmental chamber to a temperature between about −20° F. to about +10° F.;

(h) producing an additional layer of snow on top of the first snow layer, the additional snow layer having a thickness of between about 1 to about 2 inches;

(i) packing the additional layer of snow;

(j) applying a coating of water to an upper surface of the additional layer of snow, said coating of water being applied at a volume from about 1 to about 1.6 gallons per 100 square feet of snow surface;

(k) grooming the water coated additional layer of snow;

(l) repeating steps (h) through (k) until an operative thickness of packed and groomed snow is produced; and, (m) raising a temperature of the environmental chamber to between about 10° F. to about 25° F., thereby providing a snow surface shear strength suitable for establishing traction values for a vehicle tire.

2. The process according to claim 1 wherein steps (j) and (k) are carried out simultaneously.

3. The process according to claim 1 wherein said grooming step comprises at least three sled passes across the snow surface, at least one of said three passes being in a cross direction relative to the other sled passes.

4. The process according to claim 1 wherein said step (g) of lowering the temperature further includes lowering the temperature to between about 0° F. to about 5° F.

5. The process according to claim 1 wherein said step (e) of adjusting a temperature further provides adjusting the temperature to between about 0° F. to about 10° F.

6. The process according to claim 1 wherein said step (m) of raising a temperature further provides raising the temperature to about 15° F. to about 20° F.

7. The process according to claim 1 wherein said snow-making apparatus has a water supply pressure of between about 65 psi and 70 psi and further comprises a nozzle arrangement defining a first row of nozzles, each individual nozzle within said first row having a respective water flow rate of about 3.5 gpm, 5.2 gpm, 1.7 gpm, 5.2 gpm, 5.2 gpm, 1.7 gpm, 5.2 gpm, and 3.5 gpm and further defining a second row of nozzles, the individual nozzles within said second row having a respective flow rate of about 3.5 gpm, 1.7 gpm, 5.2 gpm, 1.7 gpm, 5.2 gpm, 5.2 gpm, 1.7 gpm, 5.2 gpm, 1.7 gpm, and 3.5 gpm.

8. A process of re-conditioning a snow surface following a tire evaluation, the re-conditioning comprising the steps of:

(a) applying a coating of water to an upper surface of a packed snow tire evaluation surface;

(b) grooming the water-coated snow surface with a toothed sled, the sled traveling in a direction corresponding to a travel direction of a test lane defined within the snow surface;

(c) making a second pass of the toothed sled in a direction parallel to the first direction of sled travel;

(d) making a third pass of the toothed sled in a direction transverse to the travel direction of said first and said second passes; and, (e) evaluating a shear strength of the re-conditioned snow surface.

9. The process according to claim 8 wherein said process further comprises an initial step of supplying a manufactured snow layer to said snow surface, said snow layer having a thickness of about 0.5 to about 2.0 inches; and, packing said layer of manufactured snow prior to said step of applying a coating of water.

10. The process according to claim 8 wherein said step of applying a coating of water further defines providing a volume of water of between about 1.0 to about 1.6 gallons per 100 square feet of snow surface.

11. The process according to claim 8 wherein said step of applying a coating of water and said step of grooming the water-coated snow surface are carried out simultaneously.

12. A process of making a snow surface suitable for the evaluation of a tire comprising:

(a) providing an environmental chamber;

(b) establishing a temperature within the environmental chamber below a freezing point of water;

(c) providing a foundation layer of ice on a floor of the environmental chamber;

(d) providing at least one snow-making apparatus within the environmental chamber;

(e) adjusting a temperature within the environmental chamber to between about −5° F. to about 20° F.;

(f) producing a first snow layer onto the foundation layer of ice, said first snow layer having a thickness of between about 0.5 to about 1.5 inches;

(g) lowering the temperature within the environmental chamber to a temperature between about −20° F. to about 10° F.;

(h) producing a second layer of snow on top of said first snow layer, said second snow layer having a thickness of between about 1 to about 2 inches;

(i) packing the second layer of snow;

(j) applying a coating of water to an upper surface of the second layer of snow while passing a grooming sled over said snow surface;

(k) additionally grooming the second layer of snow, said grooming including at least one pass of said sled in a direction transverse to a prior direction of travel of said sled;

(l) producing an additional layer of snow on top of said second snow layer, the additional layer having a thickness of about 1 to 2 inches;

(m) packing the additional layer of snow;

(n) applying a coating of water to an upper surface of the additional layer of snow while passing a grooming sled over a surface of the additional layer of snow;

(o) further grooming the additional layer of snow with a toothed sled, said grooming step including at least one pass of the upper snow layer with the toothed sled in a travel direction transverse to a prior travel direction;

(p) repeating steps (l) to (o) until a snow thickness of at least 5 to 6 inches of a packed and groomed snow is produced;

(q) raising a temperature of the environmental chamber to between about 10° F. to about 25° F., thereby obtaining a shear strength suitable for establishing traction values for a vehicle tire.

13. The process according to claim 12 wherein said step (g) of lowering the temperature further provides lowering the temperature to between about 0° F. to about 5° F.

* * * * *